United States Patent [19]

Padilla et al.

[11] 4,442,900

[45] Apr. 17, 1984

[54] SUBSEA WELL COMPLETION SYSTEM

[75] Inventors: Joseph R. Padilla, Houston; Emmett M. Richardson, Duncanville; Angelos T. Chatas, Dallas, all of Tex.

[73] Assignee: Mobil Oil Corporation, New York, N.Y.

[21] Appl. No.: 343,634

[22] Filed: Jan. 28, 1982

[51] Int. Cl.[3] ..... E21B 33/043

[52] U.S. Cl. ..... 166/342; 166/356; 166/366; 166/368; 405/188; 405/169

[58] Field of Search ..... 166/339, 340, 341-343, 166/350, 356, 362, 366, 368; 405/188, 169, 227; 175/7

[56] References Cited

U.S. PATENT DOCUMENTS

| | | | |
|---|---|---|---|
| 2,988,144 | 6/1961 | Conrad | 166/362 X |
| 3,220,477 | 11/1965 | Jones | 166/342 X |
| 3,504,740 | 4/1970 | Manning | 166/362 |
| 3,556,208 | 6/1968 | Dean | 166/356 X |

*Primary Examiner*—Ernest R. Purser
*Attorney, Agent, or Firm*—Alexander J. McKillop; Michael G. Gilman; George W. Hager, Jr.

[57] ABSTRACT

A subsea well completion system, and components of such a system, are disclosed for handling marine well fluids from multiple subsea wells. The system includes a fluid-tight work enclosure hull containing manifold means, the hull having a plurality of radially-disposed lateral penetration means extending therethrough, the penetration means being operatively connected to the manifold means; and a base template having means for securing the template to the marine floor in a substantially horizontal position and having a lower support structure for supporting the work enclosure hull, the template further having an upper guidance structure comprising a plurality of substantially vertical guide members mounted in spaced radial array, each guide member extending inwardly toward the center of the template, forming an opening at the central portion of the template for receiving the work enclosure hull, a portion of the upper peripheral surface of each guide member sloping downwardly toward the opening for guiding the hull as it is lowered during installation of the hull onto the template. A method of establishing production capability from multiple subsea wellheads on a base template secured to the marine floor is also disclosed employing the aforecited system components.

35 Claims, 12 Drawing Figures

41
31
13
32
30
42

30
36
42
34
PDT LUBRICATOR
PDT-TOOL INJECTOR
40
HYDRAULIC ACCUMULATORS
39
NITROGEN
AIR
26

100
61
100
41
13
60
18
15
19
19
20
20
100
100
20
27
29
25'
21
38
27
26
25
14
16
24
101
11

SUBSEA WELL COMPLETION SYSTEM

BACKGROUND OF THE INVENTION

This invention relates to a subsea well completion system for handling oil and/or gas production from multiple offshore wells, and to the components of such a system. In particular, it provides a system, its components, and a method for establishing fluid communication and production capability between multiple template-drilled wells and a production pipeline via a subsea atmospheric manifolding chamber.

This invention relates to the production of hydrocarbon fluids from subaqueous formations utilizing a system of submerged, template-drilled wellheads and a submerged well completion system. Recent developments in the offshore oil and gas industry extend production to undersea areas, such as the outer fringes of the continental shelves and the continental slopes. A submarine production system is believed to be the most practical method of reaching the subaqueous deposits. Although hydrocarbons are the main concern at this time, it is contemplated that subaqueous deposits of sulfur and other minerals can be obtained from beneath the seas. While bottom-supported permanent surface installations have proved to be economically and technologically feasible in comparatively shallow waters, in deeper waters, such as several hundred to several thousand meters, utilization of such surface installations must be limited to very special situations. Installations extending above the water surface are also disadvantageous even in shallower water where there are adverse surface conditions, as in areas where the bottom-supported structure of the above-surface production platforms are subject to ice loading.

Subsea systems are feasible for installing multiple wellheads in relatively close proximity through the use of a drilling template secured on the marine floor. Such systems can be operated from remote, floating surface facilities using electrohydraulic control systems, with the subsea systems being connected to the surface facilities by flowlines for production fluids, injection fluids, hydraulic controls, electric cable, and the like.

Habitable, subsea work enclosures, or satellites, can be maintained adjacent multiple, template-drilled wellheads for housing operating and/or maintenance personnel, as disclosed, for example, in U.S. Pat. No. 3,556,208 (Dean). In such systems, the subsea satellite is independently connected to a number of surrounding subsea wellheads and serves to control the production from, and maintenance of, the wellheads. The wells are drilled in a circular pattern through a template on the marine floor, the template serving also as a base upon which the satellite is installed. The production/control passages of each of the wells are connected to production equipment within the satellite by separate connector units which are independently lowered into place from a surface vessel and form portions of the flow paths between the wellheads and the production equipment within the satellite.

While the aforementioned subsea satellite systems prove generally satisfactory in water depths of about 100 to 150 meters, the use of such systems at depths on the order of 300 to 750 meters presents certain problems. For example, the utilization of guidelines and diver assistance for subsea installation of the components of the system becomes more complex with increasing water depths. In waters of such substantial depth, it becomes necessary to employ dynamic guidance systems, including remote television and/or sonar monitoring, during the installation process. Furthermore, subsea installation of the satellite on the template in prior systems presents problems in terms of guidance of the satellite into proper position on the template and the need to fasten the satellite to the template. Also, prior art subsea well completion systems typically utilize submerged work enclosure hulls having vertically arranged hull penetrators. Such an arrangement of the penetrators produces undesirable hull stress conditions, particularly at depths in excess of 150 meters.

It is an objective of the present invention to overcome the problems and disadvantages of the prior art by providing an improved subsea well completion system, and component parts thereof, capable of simplified, guidelineless installation on the marine floor, as well as an improved subsea satellite installation procedure. It is a further objective of the present invention to provide a subsea well completion system, and components thereof, which will facilitate and insure proper alignment and orientation of the respective components with respect to each other as they are installed on the marine floor. An additional objective is to provide structural protection for the components of the well completion system. It is also an objective of the present invention to provide an improved marine floor base template for guiding marine floor well drilling equipment at multiple wellheads and for supporting and aligning a subsea work-enclosure hull and wellhead connectors.

Additional objectives and advantages of the invention will be set forth in part in the description which follows, and in part will be obvious from the description, or may be learned by practice of the invention. The objectives and advantages of the invention will be realized and attained by means of the instrumentalities and combinations, particularly pointed out in the appended claims.

To achieve the objectives and in accordance with the purpose of the invention, as embodied and broadly described herein, the invention comprises a subsea well completion system for multiple subsea wells, including a fluid-tight work enclosure hull containing manifold means, the hull having a plurality of radially-disposed lateral penetration means extending therethrough, the penetration means being operatively connected to the manifold means, and a base template having means for securing the template to the marine floor in a substantially horizontal position and having a lower support structure for supporting the work enclosure hull, the template further having an upper guidance structure comprising a plurality of substantially vertical guide members mounted in spaced radial array, each guide member extending inwardly toward the center of the template, forming an opening at the central portion of the template for receiving the work enclosure hull, a portion of the upper peripheral surface of each guide member sloping downwardly toward the opening for guiding the hull as it is lowered during installation of the hull onto the template.

As embodied and broadly described herein, the invention comprises a subsea well completion system for establishing production capability from multiple subsea wells, comprising a fluid-tight work enclosure hull containing manifold means, the hull having a plurality of radially-disposed lateral penetration means extending therethrough, the penetration means being operatively connected to the manifold means and a base template having means for securing the template to the marine floor in a substantially horizontal position and having a lower support structure for supporting the work enclosure hull, the lower support structure of the template includes a plurality of substantially vertical well conductor pipes spaced around the template at a common radial distance from the center of the template for aligning the individual wells during drilling, the upper section of each conductor pipe terminating in a wellhead, the template further having an upper guidance structure comprising a plurality of substantially vertical guide members mounted in spaced radial array, each guide member extending inwardly toward the center of the template forming an opening at the central portion of the template for receiving the work enclosure hull, a portion of the upper peripheral surface of each guide member sloping downwardly toward the opening for guiding the hull as it is lowered during installation of the hull onto the template.

As embodied and broadly described herein, the invention further comprises a subsea system for handling marine well fluids from multiple subsea wells, comprising a fluid-tight work enclosure hull having a plurality of radially-disposed lateral penetration means for releasable fluid connection through the hull, a base template having well bay forming means comprising a plurality of vertical dividers mounted in spaced radial array on the template and extending inwardly from the outer peripheral portion of the template toward the central portion of the template, the upper peripheral surface of each dividing means sloping downwardly toward the central portion of the template for guiding the work enclosure hull as it is lowered during installation onto the template, wellhead connector means installed in a well bay for releasably connecting a wellhead to a penetration means to establish fluid communication therebetween, the wellhead connector means comprising a fluid connection assembly and a rigid, open guide frame surrounding and rigidly secured to the fluid connection assembly, the width of the radially outermost portion of the guide frame, with respect to the central portion of the template, being adapted to prevent lateral and radial inward misorientation of the guide frame and the wellhead connector means as they are moved laterally into the well bay during installation thereof onto the template.

Broadly, a subsea base template for guiding marine floor well drilling equipment at multiple wells and supporting a subsea work enclosure hull and wellheads in accordance with the invention comprises a lower support structure comprising a substantially horizontally aligned, open tubular framework and a plurality of substantially vertical well conductor pipes spaced around the peripheral portion of the framework and integral therewith for aligning the well drilling equipment, the upper section of each well conductor pipe terminating in a wellhead, the central portion of the framework being adapted to support the subsea work enclosure hull and the peripheral portion being adapted to support the wellheads, and an upper guidance structure comprising a plurality of guide members rigidly mounted on, and extending vertically from, the lower support structure in spaced radial array, each guide member extending inwardly toward the center of the template, forming a substantially cylindrical opening at the central portion of the framework for receiving the work enclosure hull, a portion of the upper surface of each guide member sloping downwardly toward the cylindrical opening for guiding the work enclosure hull as it is lowered during installation thereof onto the template, the guide members further providing structural protection for the work enclosure hull and the wellheads.

A subsea base template for guiding marine floor well drilling equipment at multiple wells and supporting a subsea work enclosure hull and wellheads in accordance with the invention also comprises a lower support structure comprising a substantially horizontally aligned, open tubular framework and a plurality of substantially vertical well conductor pipes spaced around the peripheral portion of the framework and integral therewith for aligning the well drilling equipment, the upper section of each well conductor pipe terminating in a wellhead, the central portion of the framework being adapted to support the subsea work enclosure hull and the peripheral portion being adapted to support the wellheads; and an upper guidance structure comprising a plurality of guide members rigidly mounted on, and extending vertically from, the lower support structure in spaced radial array, each guide member extending inwardly toward the center of the template, forming a substantially cylindrical opening at the central portion of the framework for receiving the work enclosure hull, a portion of the upper surface of each guide member sloping downwardly toward the cylindrical opening for guiding the work enclosure hull as it is lowered during installation thereof onto the template the guide members further providing structural protection for the work enclosure hull and the wellheads, wherein the upper guidance structure further comprises blocking means rigidly mounted between each pair of adjacent guide members, except that said blocking means is not mounted between one pair of preselected adjacent guide members to permit receipt between the one pair of guide members of a work enclosure hull alignment means extending laterally from the periphery of the work enclosure hull as the hull is lowered during installation of the hull onto the template, thereby orienting the hull.

The invention further comprises a subsea base template for guiding marine floor well drilling equipment at multiple wells and supporting a subsea work enclosure hull, wellheads, and wellhead connector means, comprising a lower support structure comprising a substantially horizontally aligned, open tubular framework and a plurality of substantially vertical well conductor pipes spaced around the peripheral portion of the framework and integral therewith, for aligning the well drilling equipment, the upper section of each well conductor pipe terminating in a wellhead, the central portion of the framework being adapted to support the subsea work enclosure hull and the peripheral portion being adapted to support the wellheads and wellhead connector means, and an upper guidance structure comprising a plurality of guide members rigidly mounted on, and extending vertically from, the lower support structure in spaced radial array, each guide member extending inwardly toward the center of the template, forming a substantially cylindrical opening at the central portion of the framework for receiving the work enclosure hull, a portion of the upper surface of each guide member sloping downwardly toward the cylindrical opening for guiding the work enclosure hull as it is lowered during installation thereof onto the template, the vertical guide members being situated such that adjacent members define a radially inwardly tapered well bay for each wellhead for funneling the wellhead connector means into place during installation thereof onto the template, the guide members further providing structural protection for the work enclosure hull, the wellheads, and the wellhead connector means.

As embodied and broadly described herein, the invention further comprises a method of establishing production capability from multiple subsea wellheads on a base template secured to the marine floor, comprising: providing a work enclosure hull containing a manifold, the hull having a substantially cylindrical portion with a plurality of radially-disposed lateral hull penetrators extending therethrough and operatively connected to the manifold; providing an upper guidance structure on the template comprising a plurality of substantially vertical guide members mounted in spaced radial array, each guide member extending inwardly from the outer periphery of the template, thereby providing a substantially cylindrical opening at the central portion of the template for receiving the work enclosure hull, and portion of the upper peripheral surface of each guide member sloping downwardly toward the cylindrical opening; lowering the work enclosure hull from a position directly above the template and funneling it through the upper guidance structure into the cylindrical opening at the central portion of the template, the work enclosure hull being guided into its resting position on the template by the guide members; and establishing subsea fluid communication between the subsea wellheads and the work enclosure hull.

The accompanying drawings, which are incorporated in and constitute a part of this specification, illustrate exemplary embodiments of the invention and, together with the description, serve to explain the principles of the invention.

THE DRAWINGS

DESCRIPTION OF PREFERRED EMBODIMENTS

Reference will now be made in detail to the presently preferred embodiments of the invention, examples of which are illustrated in the accompanying drawings.

Figure 1:
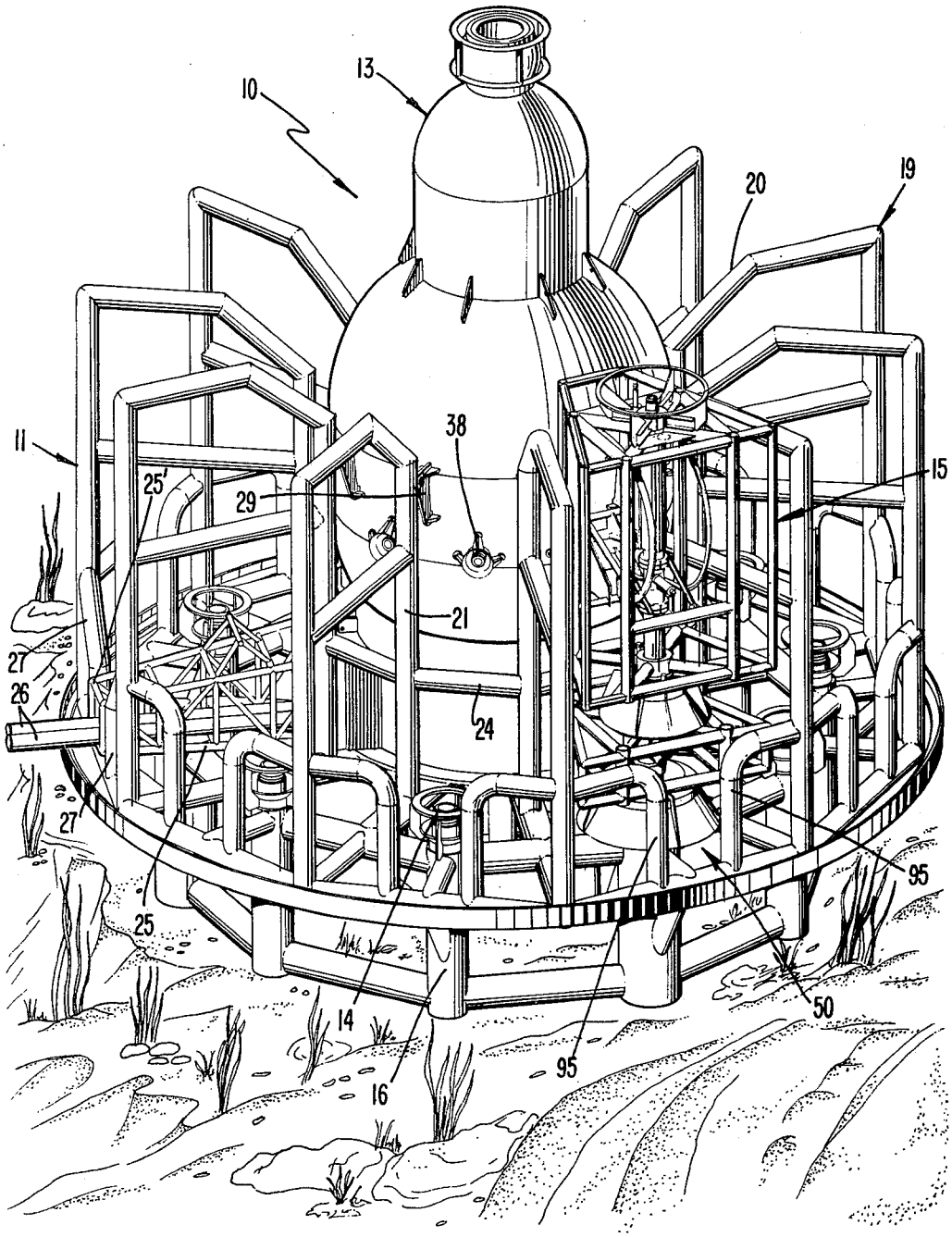
FIG. 1 is a perspective view of the improved subsea well completion system of the present invention, for guidelineless installation.

A preferred embodiment of the subsea well completion system is shown in FIG. 1, and is represented generally by the numeral 10. The system includes a base template, designated generally by the numeral 11, having a lower support structure for supporting a work enclosure hull 13, individual wellheads 14, and wellhead connector means 15. Wellheads 14 are mounted on well conductor pipes 16 forming a portion of the lower support structure of base template 11.

A semisubmersible drilling rig (not shown) lowers base template 11 to the marine floor on a drilling riser in a known manner. Drilling of each well through base template 11 is accomplished using a conventional blow out preventer (BOP) stack and conventional drilling procedures. Preferably, base template 11 is constructed such that a BOP stack will be contained within its designated well location by vertical guides 19, thereby preventing overlap or entry into adjacent well locations. When a well is completed, a master valve assembly 50 (described below) is preferably lowered on a drilling riser (not shown) and operatively connected to wellhead 14 to cap it. Work enclosure hull 13 is installed on base template 11 by lowering it on a riser from a semisubmersible drilling vessel and oriented by rotating the riser, using television cameras or sonar to determine the orientation. Installation of work enclosure hull 13 on base template 11 is preferably performed without the use of guidelines. Wellhead connector means 15 are then lowered from the drilling rig on a drill pipe and operatively connected between each master valve assembly and manifold means housed within work enclosure hull 13 via lateral penetration means 38 extending through the hull. The manifold means, in turn, connects to pipelines and flow lines extending through work enclosure hull 13. Work enclosure hull 13 must land and lock on base template 11 within a determined rotational asimuth tolerance to allow lateral penetration means 38 to be within an acceptable reach of the corresponding wellhead connector means 15.

The well completion system of the invention is operated from a remote surface production facility through the use of conventional electrohydraulic control systems, with the well completion system being connected to the surface facility by pipelines, fluid service lines, hydraulic lines, and electric cables. Production and control equipment inside work enclosure hull 13 is maintained by personnel brought to the chamber in a submersible or tethered transfer vehicle. Well repair is performed either by vertical reentry techniques from a floating drilling rig, or through the use of pump-down tools (PDT) launched from inside work enclosure hull 13 and controlled from the remote surface facility.

Where desirable, e.g. for deeper water applications, all subsea components of the well completion system of the present invention are installed on base template 11 without the use of guidelines. Wellhead connector means 15, master valve assemblies 50, and blow out preventer stacks (not shown) are preferably equipped with a specially designed bumper structure (described in detail below) to mate with a specially designed upper guidance structure section of base template 11.

Figure 2:
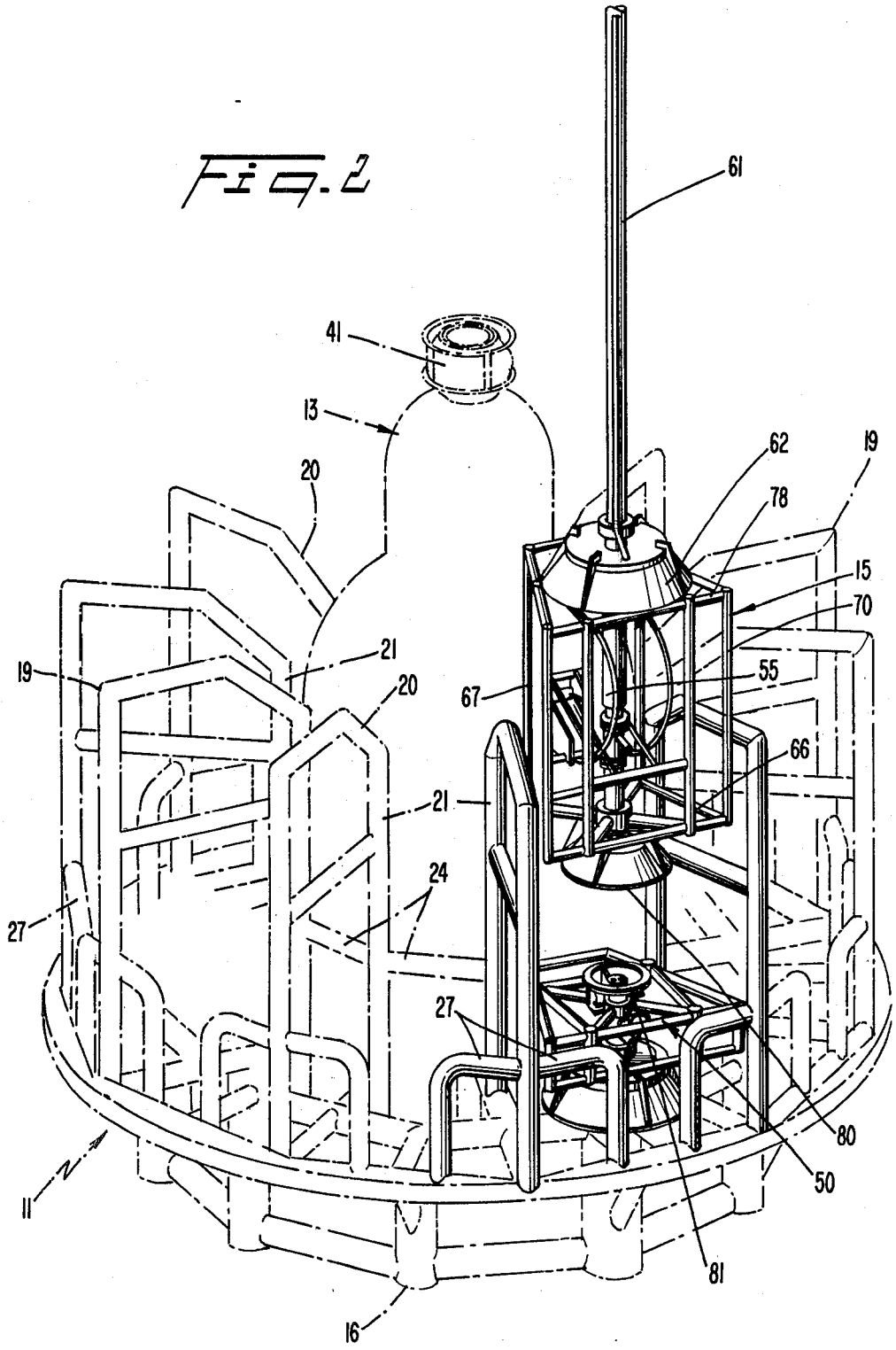
FIG. 2 is a perspective view, in partial phantom, of the improved well completion system, showing guidelineless installation of one of its components.

Referring to FIG. 2, the component to be landed on base template 11 is lowered by drill pipe 61 to a point preferably outside the well bay, for safety in the event the component should be accidentally dropped, and is oriented by rotating the drill pipe using remote television or sonar to monitor the operation. Then the component is moved horizontally into the well bay structure and lowered for landing on wellhead 14 or master valve assembly 50, using running tools similar to those conventionally used for installing wet subsea trees. A preferred embodiment of the guidelineless well completion system of the present invention, with one wellhead connector means 15 and one master valve assembly 50 installed, or being installed, is shown in FIGS. 1 and 2.

Referring to FIGS. 1–4, the lower support structure of base template 11 also includes means for securing the template to the marine floor in a substantially horizontal position. Wellheads 14 and well conductor pipes 16 are of conventional construction.

Base template 11 further includes an upper guidance structure comprised of a plurality of substantially vertically extending guide members 19 mounted on the template in spaced radial array. Each vertical guide member 19 extends from the outer periphery of the base template inwardly, leaving a substantially cylindrical opening at the central portion of the template, defined by the respective vertical inner legs 21 of each guide member 19, for receiving work enclosure hull 13. A portion 20 of the upper peripheral surface of each guide member 19 slopes downwardly toward the cylindrical opening to serve as a funnel. Preferably, sloping portion 20 defines an angle of about 45° to the horizontal.

To initially install work enclosure hull 13 on the central position of base template 11, the hull is lowered by a conventional drill string or riser (not shown) from a floating or semi-submersible vessel (not shown) in the general vicinity above the template. The drill string may be connected to work enclosure hull 13 using a connector 18 (see FIG. 12) coaxially secured to an upper portion of the hull. As work enclosure hull 13 contacts the upper guidance structure of base template 11, sloping portions 20 will serve to funnel hull 13 into the substantially cylindrical opening defined by legs 21 of the template upper guidance structure at the central portion of the template, thus ensuring proper positioning of the hull at the central portion of the template.

In addition to providing guidance to work enclosure hull 13 during guidelineless installation onto base template 11, the upper guidance structure of base template 11 provides protection against damage to the hull. As a result of its rigid construction, this structure serves as a protective cage surrounding work enclosure hull 13. Base template 11 is preferably constructed from rigid structural piping, using an open frame construction, as shown. In addition to its strength, such piping permits control of the bouyancy of the template, to aid in its installation on the marine floor.

Further guidance and orientation is preferably provided by guide flanges 22 (FIG. 3), which extend radially inwardly from legs 21 and have downwardly inclined upper surface portions 23.

While other shapes are possible, base template 11 is preferably circular in shape, when viewed from above, with wellheads 14 and well conductor pipes 16 spaced about its circumference, preferably at a common radial distance from the center of the template. In such a system, vertical guide members 19 are preferably spaced apart equidistantly.

The upper guidance structure of base template 11 also preferably possesses crosspieces 24 of structural piping extending between adjacent vertical legs 21, and rigidly secured thereto. As will be explained below, cross pieces 24 serve as blocking means, whereby the omission of a crosspiece 24 between a preselected pair of legs 21 further facilitates alignment and orientation of work enclosure hull 13 in its desired position during installation on base template 11.

Base template 11 may be provided with ballast tanks (not shown) for ease of handling during towing and installation of the structure. Preferably, base template 11 is an open, welded metal structure with tubular metal frame, cross-braced for strength.

Figure 5:
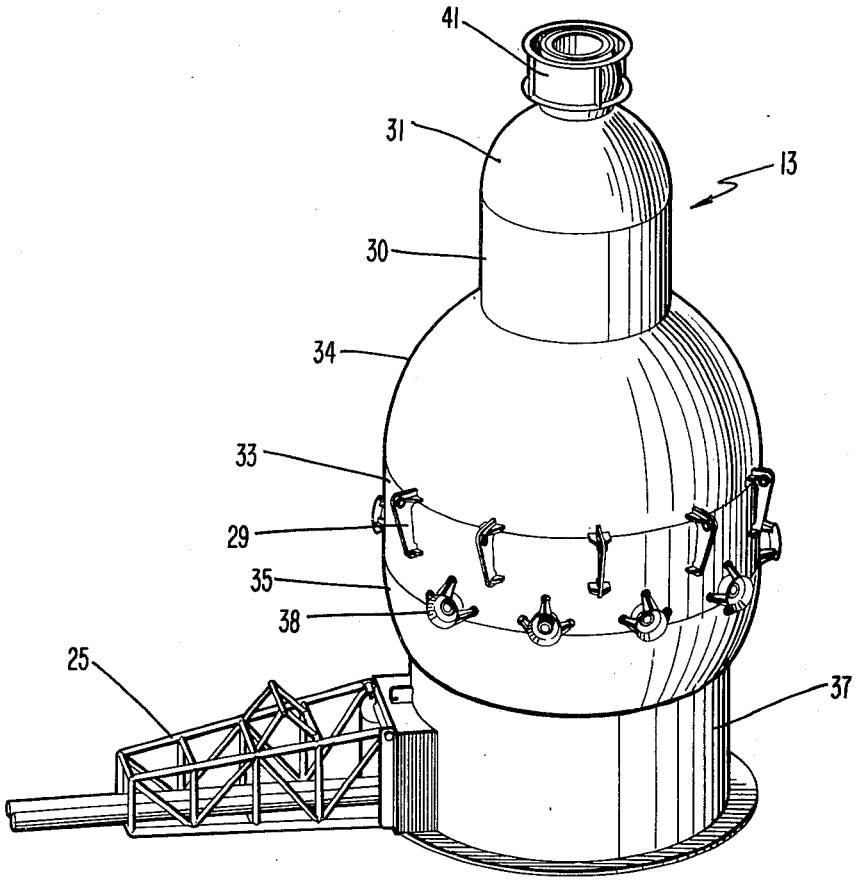
FIG. 5 is a perspective view of the improved subsea work enclosure hull of the present invention, showing the attached pipeline boom and pipeline.

Referring now to FIGS. 1 and 5, as mentioned, work enclosure hull 13 is installed on the subsea base template 11 by lowering it on a drill string without the use of guidelines. To further assist in aligning and orienting work enclosure hull 13 in the desired position at the central portion of base template 11, a work enclosure hull alignment means 25 preferably extends from the periphery of work enclosure hull 13. As embodied herein, work enclosure hull alignment means comprises a pipeline boom. Disposed within pipeline boom 25 are one or more pipelines and flow lines 26 extending through work enclosure hull 13 to its interior (discussed in greater detail below). The external dimensions of pipeline boom 25 are selected so as to provide a close fit between the boom and adjacent vertical legs 21 of the upper guide structure of base template 11. During installation, crosspieces 24 serve as effective boom blocking means, precluding the lowering of pipeline boom 25, thus requiring that the pipeline boom may only be lowered between the single pair of vertical legs 21 having no crosspiece 24, thereby ensuring the desired orientation of work enclosure hull 13.

Figure 3:
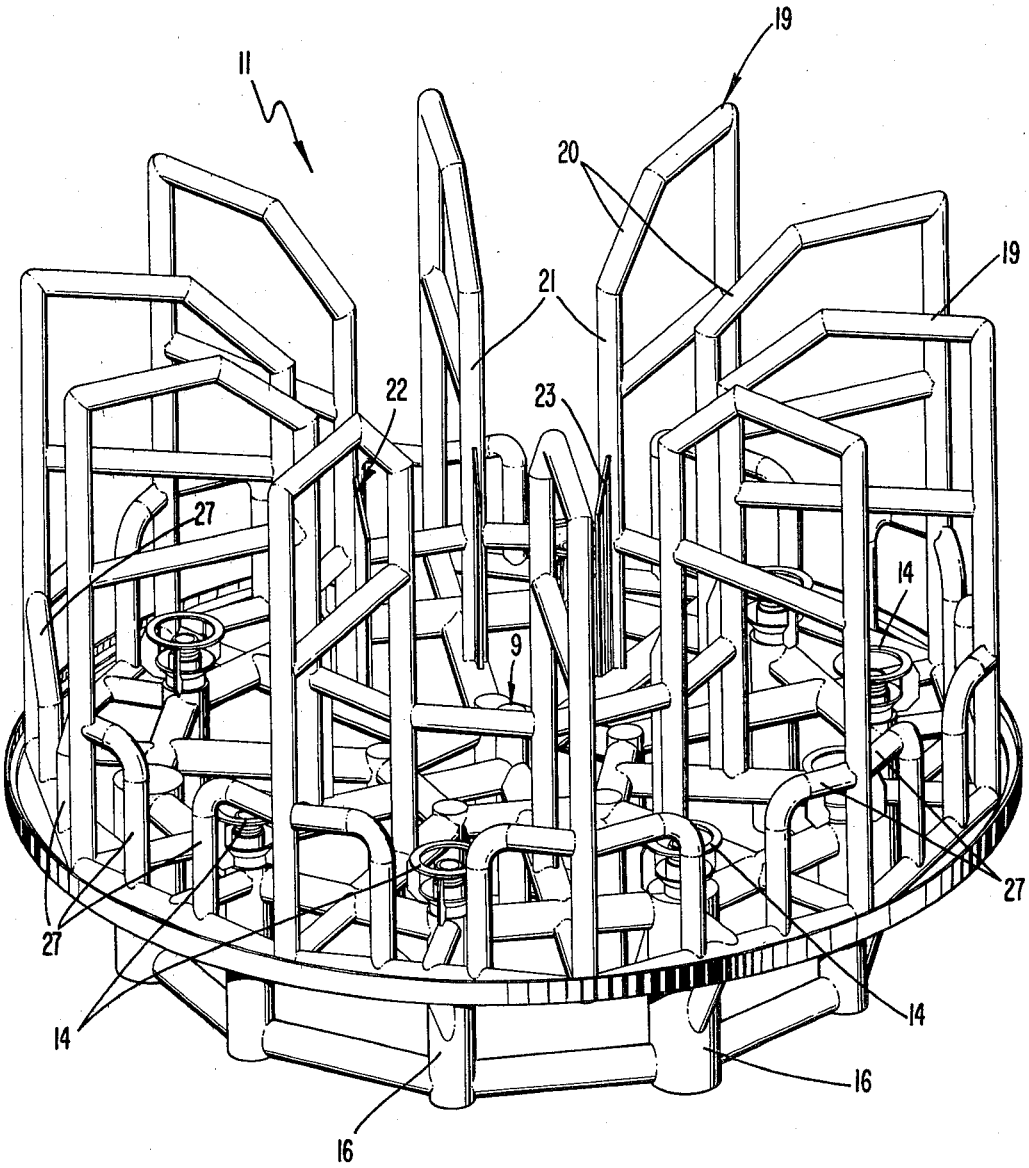
FIG. 3 is a perspective view of the improved marine floor base template of the present invention, for guidelineless installation.

As best shown in FIGS. 1 and 3, base template 11 preferably further comprises pipeline boom alignment bumpers 27 for providing finer alignment of boom 25 between vertical guide members 19. Pipeline boom 25 preferably tapers toward a narrower end portion 25', and bumpers 27 are spaced along the periphery of base template 11 at a distance designed to ensure a close fit of this narrower end portion. As shown, bumpers 27 also preferably include downwardly sloping portions adapted to guide end portion 25' as it is lowered during installation on base template 11.

Preferably at least one laterally extending positioning stop 29 is secured to the outer periphery of the cylindrical portion of work enclosure hull 13 for contacting vertical leg 21 of a guide member 19 to block movement of the hull when it is rotated during installation of the hull on base template 11, thus further facilitating orientation of the hull with respect to the template. Positioning stops 29 may also serve as lifting tabs or gussets for surface handling of work enclosure hull 13.

Utilizing the procedures discussed above, a work enclosure hull may be installed on a marine floor base template without the use of guidelines at water depths on the order of 750 meters. Acoustic beacons and sonar reflectors, as well as remote television cameras may be used to monitor the position and orientation of the work enclosure hull relative to the base template during installation.

Figure 4:
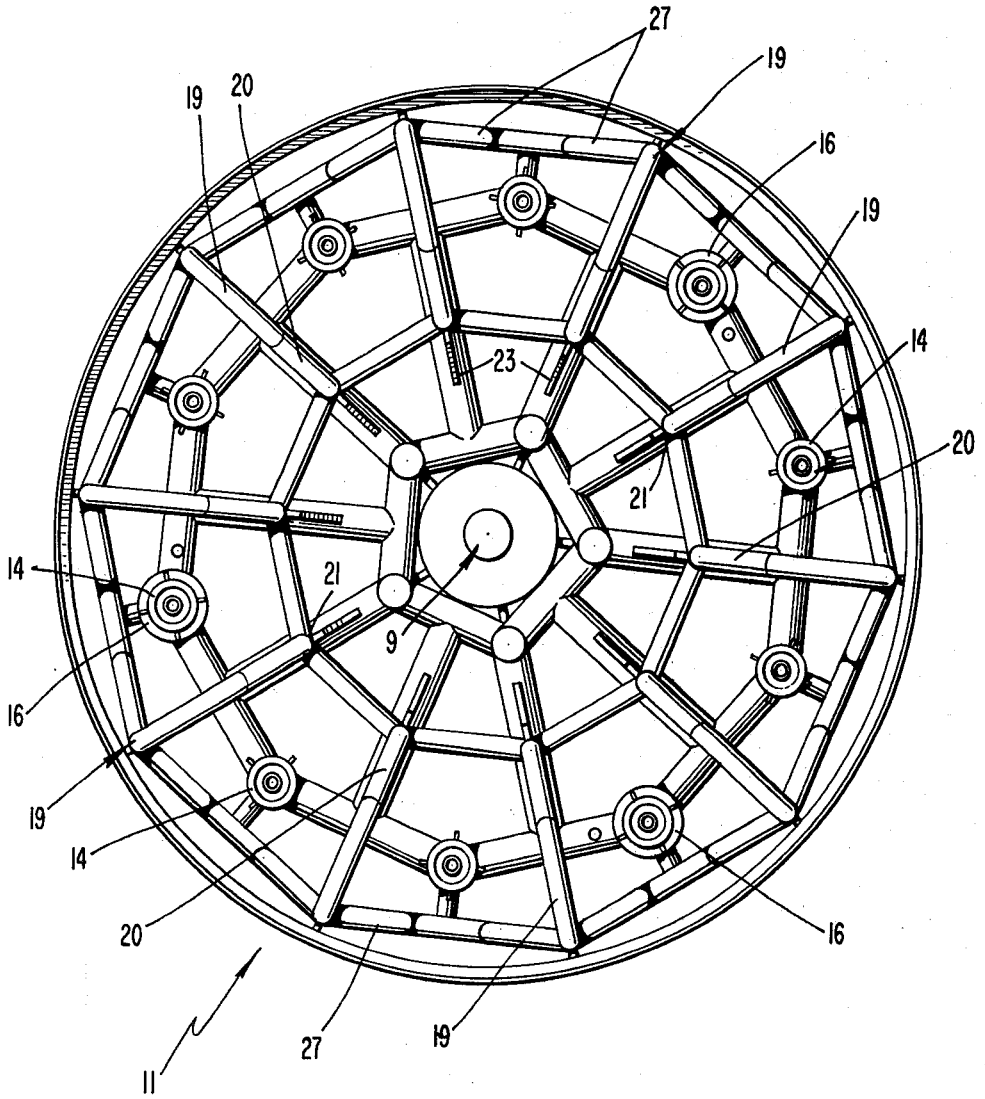
FIG. 4 is a plan view of the marine floor base template shown in FIG. 3.

FIGS. 1 and 2 illustrate marine floor base templates 11 constructed in accordance with the present invention and having work enclosure hulls 13 installed thereon, whereas FIGS. 3 and 4 illustrate marine floor base templates 11, in perspective and plan views, respectively, prior to installation of work enclosure hull 13. In these Figs., the features described above bear the same respective numerals.

Figure 6:
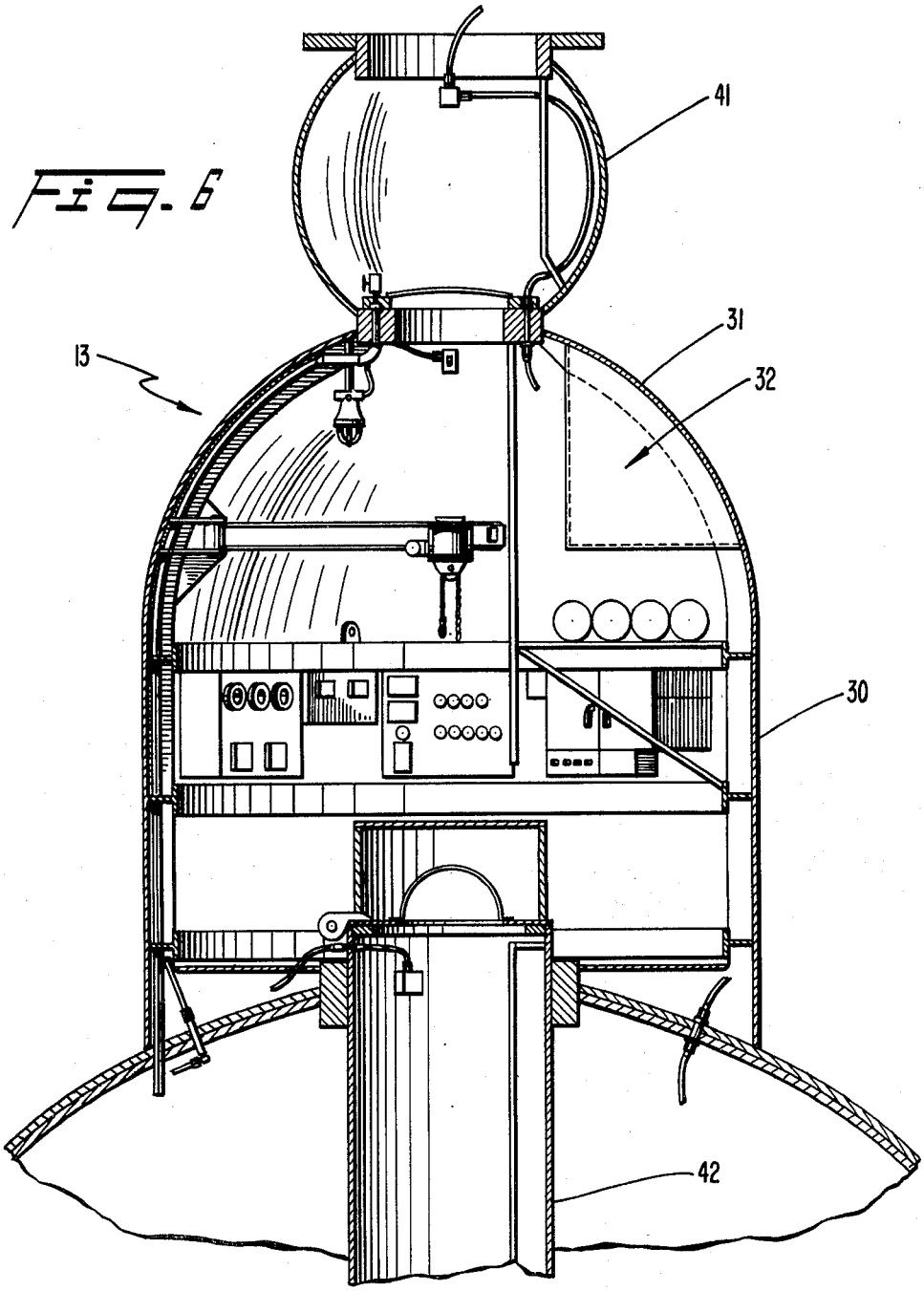
FIG. 6 is a cross-sectional plan view of the upper control section of the work enclosure hull, showing internal monitoring and control equipment.
Figure 7:
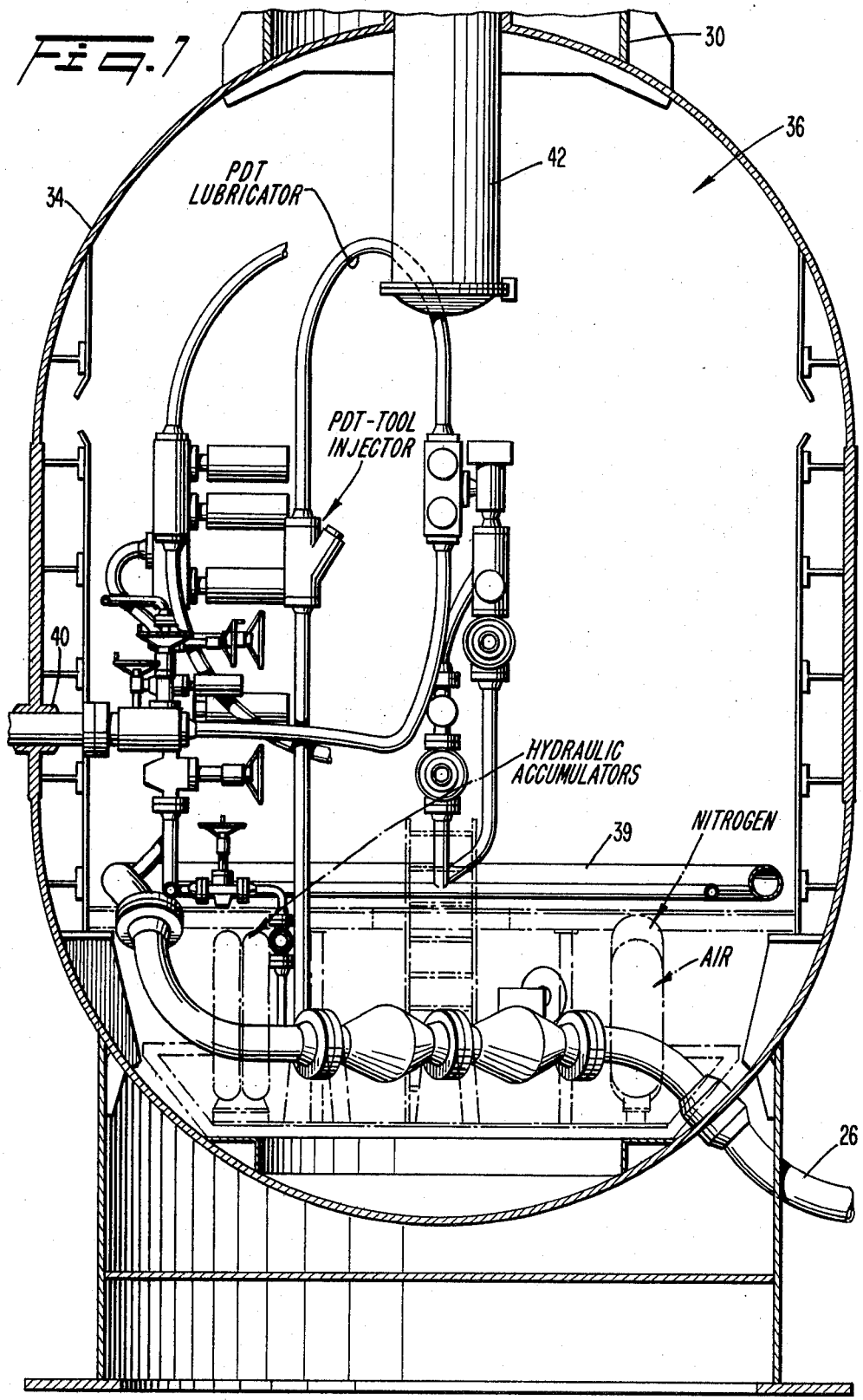
FIG. 7 is a cross-sectional side elevation view of the lower service section of the work enclosure hull, showing a portion of the internal fluid handling apparatus.

Referring now to FIGS. 5–7, the work enclosure hull 13 of the present invention preferably comprises a vertically oriented, stepped cylinder. The upper, smaller cylindrical section 30, together with complementary hemispherical end section 31 surround a control section 32. The lower, larger cylindrical section 33 is topped by complementary hemispherical section 34, which joins at its top with the lower periphery of smaller cylindrical section 30. Lower hemispherical section 35 extends from the bottom of cylindrical section 33 and completes the enclosure for service section 36. Service section 36 is supported by skirt member 37 having flow line boom 25 extending therefrom.

Spaced about the periphery of cylindrical section 33, and extending generally horizontally therefrom, are lateral penetration means 38, for establishing well fluid communication through work enclosure hull 13. Horizontal alignment of lateral penetration means 38 through hull 13 provides significantly improved hull stress relief when compared with vertical alignment through upper hemispherical section 31.

Service section 36 (FIG. 7) houses production manifold 39 which is operatively connected to one or more pipelines 26 extending through work enclosure hull 13, as shown in FIG. 7.

Figure 8:
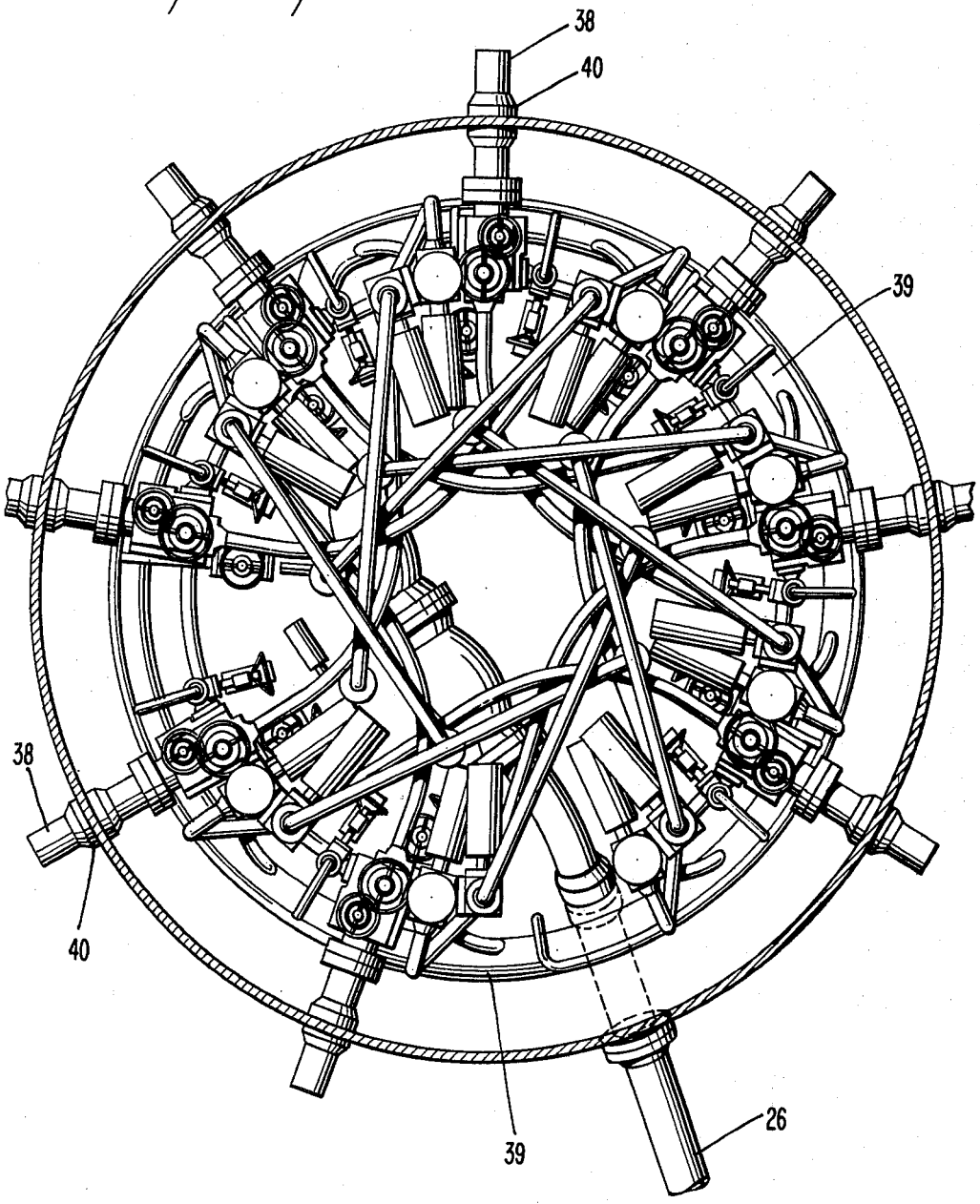
FIG. 8 is a cross-sectional plan view, in partial phantom, of the lower service section shown in FIG. 7.

A portion of the internal fluid handling system of a typical service section 36, as shown in FIGS. 7 and 8, provides for operatively connecting the internal terminations 40 of the integrally welded penetration means 38 to manifold 39. Various produced petroleum streams, gas streams, water streams, chemical injection streams, test streams and hydraulic lines can be manifolded through their respective lines and valves individually according to the desired production schedules. The manifolding and valving are preferably designed to permit the passage of pump-down tools (PDT) from the subsea work enclosure out to and down the individual wells. In such a case, a lubricator, to permit loading the pump-down tools into the system piping, must be connected to a power fluid supply line from a surface facility to satisfy the requirement for large pumping capability, metering, fluid treating and storage. Capability will preferably be provided to switch the individual well function (from production to test to service) during the operating life of the well, if necessary. Internal valve means permit sequencing or combining fluids according to the desired production schedules. Remotely-actuated and/or manual valve operations are emmployed, as desired.

FIGS. 7 and 8 illustrate relevant portions of a typical system of internal piping and valving, including PDT capability, for establishing fluid flow between a single penetration means 38 and manifold means 39. Substantially identical systems are provided for connecting each of the individual penetration means 38 spaced about work enclosure hull 13 to manifold means 39. The complete details of such other systems have been omitted from FIGS. 7 and 8 for clarity. PDT servicing requires that at least a 1.52 meter bending radius be maintained on all piping bends through which pump-down tools will pass.

Service section 36 comprises an atmospheric chamber enclosed within work enclosure hull 13. An explosion-inhibiting inert atmosphere, such as nitrogen, is maintained within the service section 36. A structural bulkhead and purgable compartment 42 are provided for transferring personnel between work section 36 and control section 32, while keeping the two atmospheres in the respective sections separated and free from mixing through the use of conventional air lock transfer techniques. Plug-in type breathing equipment is utilized by personnel in work section 36.

Control section 32 (FIG. 6) comprises an atmospheric chamber in which is maintained a breathable atmosphere, rendering the control section habitable. The life support systems for habitable control section 32, as well as the required remote controls and the like, may be connected to a remote surface facility by one or more conduits for providing air, exhaust, communications, power, and the like. These conduits may piggyback with or be within pipeline 26.

Control section 32 (FIG. 6) is provided with a personnel transfer bell, or "teacup", 41 for transferring operating and maintenance personnel from a conventional submarine vessel (not shown) using atmospheric pressure transfer techniques.

Work enclosure hull 13 must be constructed with sufficient strength to withstand the extremely high pressure present at water depths on the order of 750 meters. It has been found that work enclosure hull 13 may be constructed so as to possess negative bouyancy, through proper weighting and ballasting. Such a construction avoids the necessity for any latching equipment to hold down the hull once it is installed on the marine floor base template. Preferably, work enclosure hull 13 includes slips (not shown), which may be of conventional construction, and the base template 11 includes a centrally located mandrel 9 (see FIGS. 3 and 4) extending substantially vertically upward. In this embodiment, work enclosure hull 13 is retained on base template 11 by the force of gravity and by the slips attaching to mandrel 9.

Figure 9:
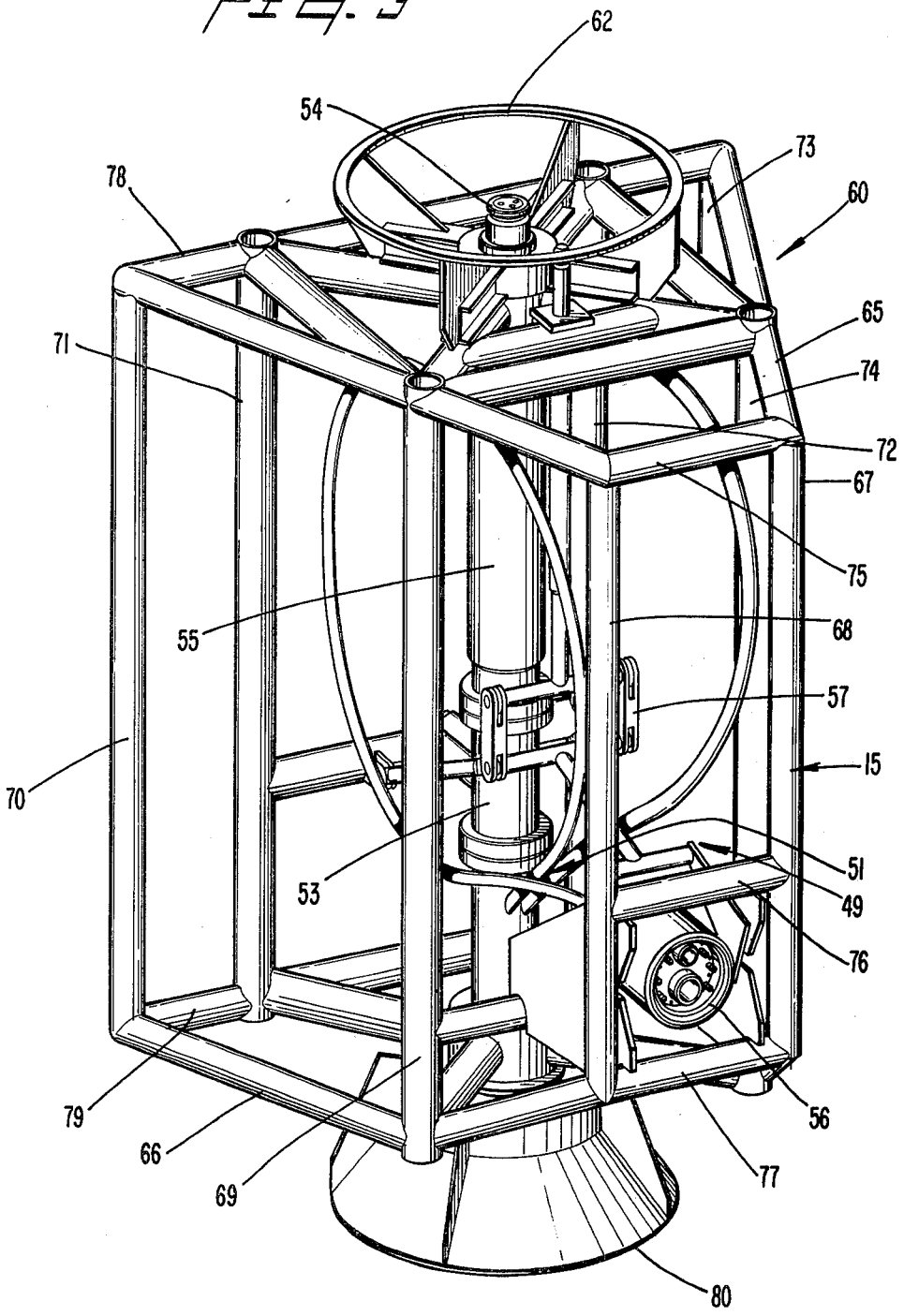
FIG. 9 is a perspective view of a wellhead connector means and its associated protective alignment frame, for guidelineless installation.

Referring to FIGS. 1 and 9, the well completion system of the present invention further comprises wellhead connector means 15 for connecting a wellhead 14 to a work enclosure hull penetration means 38 to establish fluid communication therebetween. As embodied herein, wellhead connector means 15 comprises a fluid connection assembly 49, and a conventional hydraulic connector (not shown), extending substantially vertically from the lower end of the assembly for operatively connecting it to wellhead 14. In a preferred embodiment, the hydraulic connector does not attach directly to wellhead 14, but is connected to a master valve assembly 50, secured to wellhead 14 for providing well shut-in capability and protection before the well is connected to work enclosure manifold 39. Master valve assembly 50, which may be of conventional construction, is installed on base template 11 before work enclosure hull 13 is installed. Master valve assembly 50 will be discussed in greater detail below.

Fluid connection assembly 49 also preferably includes a wye spool 51 extending from diverter 52, which provides fluid communication between conventional swab valves 53 and the hydraulic connector.

Swab valves 53 are preferably included for maintenance purposes, commonly referred to as "workover". In the preferred embodiment shown in FIG. 9, swab valves 53, as well as the down hole production and service bores, may be vertically accessed from the surface or a submersible work vehicle via conventional connector mandrel 54 and piping 55. In order to provide for pumpdown tool capability, wye spool 51 must be curved on a radius of at least 5 feet. Wye spool 51 is connected to lateral penetration means 38 through the use of a suitable embodiment of penetrator connector 56, with a mechanical linkage 57 being provided for movement of penetrator connector 56 into operative connection with penetration means 38. For more complete description of the construction and operation of penetrator connector 56 and lateral penetration means 38, attention is invited to U.S. Pat. No. 4,191,256 (Croy), which is hereby specifically incorporated by reference.

Upon coupling the hydraulic connector of the wellhead connector means 15 to wellhead 14, or master valve assembly 50, and coupling of penetrator connector 56 to lateral penetration means 38, well fluids exiting wellhead 14 may be communicated through work enclosure hull 13 and into manifold means 39, thus establishing production capability. The wellhead connector means 15 shown in FIG. 9, in combination with horizontal penetrationmeans 38, permit significant reduction in the size of the wellhead connector means, when compared with prior structures, while still providing external production piping which is removable for maintenance.

Wellhead connector means 15 preferably further comprises a guide frame 60 for support and protection of the fluid communication assembly 49, which is rigidly secured thereto. As shown in FIG. 2, wellhead connector means 15 may be installed on base template 11 by lowering it on a riser 61, connected to upper mandrel 54 by conventional running tool connectors. In water depths on the order of 750 meters, conventional guideline installation may, however, not be possible. Consequently, in one preferred embodiment of the invention, a specially-designed guide frame 60 serves not only as a protective cage, but also facilitates installation of wellhead connector means 15 on base template 11.

Specifically, in the preferred embodiment shown in FIGS. 2 and 9, guide frame 60 is constructed as an open, wedge-shaped bumper structure designed to mate with the well bay defined by adjacent vertical guides 19 of base template 11 for facilitating rough alignment and orientation of wellhead connector means 15 on the template. This bumper structure preferably extends the full height of fluid connection assembly 49, and is preferably comprised of extra-heavy structural piping.

In the preferred embodiment shown in FIG. 9, guide frame 60 comprises substantially symmetrical top and bottom support members 65, 66, with fluid connection assembly 49 aligned for inward, substantially horizontal connection to a mating lateral penetration means on work enclosure hull 13, and for downward, substantially vertical connection to a mating wellhead 14, either directly or via a master valve assembly 50. Top and bottom support members 65, 66 are vertically connected by open, substantially vertical structural members 67, 68, 69, 70, 71, 72, 73, 74, and have an inwardly-tapering outer dimension to facilitate alignment of guide frame 60 within a correspondingly tapered well bay section. Although the trapezoidal shape of top and bottom support members 65, 66, shown in FIG. 9 is well-suited to provide the desired inwardly-tapering outer dimension of guide frame 60, it is by no means the only suitable shape. The important factor is that guide frame 60 have opposing side portions which are tapered similarly to the tapered sides of the well bay in which wellhead connector means 15 is to be mounted (as defined by adjacent vertical guide members 19), and which are sufficiently spaced apart and extend for a sufficient length and height to provide alignment of guide frame 60 in the well bay as it is moved laterally inwardly during installation on base template 11.

It is likewise crucial that the tapered side portions of guide frame 60 taper to a narrow end width which is sufficiently narrow to permit the guide frame to fully enter the well bay, and thus position wellhead connector means 15, and particularly penetrator connector 56, sufficiently close to work enclosure hull 13, and particularly to penetration means 38, to permit their operative connection. Thus, the narrow end width defined by bumper members 75, 76, 77 must be small enough to be received adjacent to the work enclosure hull 13, as guide frame 60 is moved toward the center of base template 11 during installation.

As an alternative to the precise tapering, or wedge-shaped, guide frame 60, the desired orientation of well connector means 15 in the well bay may be achieved by making the width dimension of the radially outermost portion of guide frame 60, with respect to the center of base template 11, sufficiently large to prevent misorientation of guide frame 60. In the embodiment shown in FIG. 9, this width dimension is defined by bumper members 78, 79. In such an alternative construction, radial positioning of wellhead connector means 15 is preferably assisted by making the width dimension of the radially innermost portion of guide frame 60 (defined by bumper members 75, 76, 77 in FIG. 9) sufficiently small to be unobstructed by vertical guides 19, so as to be received adjacent work enclosure hull 13, and by proper radial positioning of fluid connection assembly 50 on guide frame 60, with respect to end bumper members 75, 76, 77.

Guidelineless installation of wellhead connector means 15 is achieved by first lowering the connector to a depth which permits contact between guide frame 60 and the upper guidance structure of base template 11. For safety reasons, wellhead connector means 15 is preferably not lowered directly over the template. This reduces the risk, should the lowering riser fail or a mishap occur, resulting in the equipment being dropped. Having reached the proper depth in the general vicinity of base template 11, wellhead connector means 15 is moved laterally in the general direction of the center of base template 15. Monitoring of its movement may be by remote television cameras, sonar, submarines, etc. Guide frame 60 will contact one or more vertical guide members 19 of base template 11, and will be guided into the well bay between adjacent vertical guide members 19, thus insuring proper orientation of wellhead connector means 15.

Referring again to FIG. 1, in a preferred embodiment of the present invention, vertical guide members 19 of base template 11 are spaced equidistantly around the template so as to divide it into equally-sized, inwardly tapered well bays, all but one of which are adapted to receive correspondingly tapered wellhead connector means 14. Each of the lateral penetration means 38 are situated on work enclosure hull 13 so as to be aligned with a wellhead connector means 14, with the horizontal spacing between all but two of the lateral penetration means being equal. Such an arrangement, together with the arrangement of wellheads 14 at a common radial distance, permits the use of equally sized and shaped well connector means 15 and provides for improved utilization of space within service section 36 of work enclosure hull 13, in terms of the arrangement of the necessary production, testing and service intervals.

Figure 10:
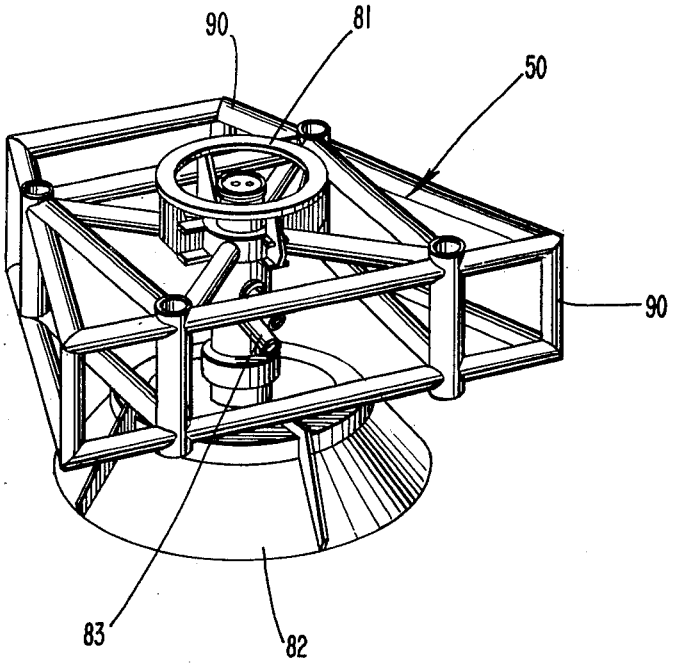
FIG. 10 is a perspective view of the improved master valve assembly and associated protective alignment frame for guidelineless installation in accordance with the invention.
Figure 11:
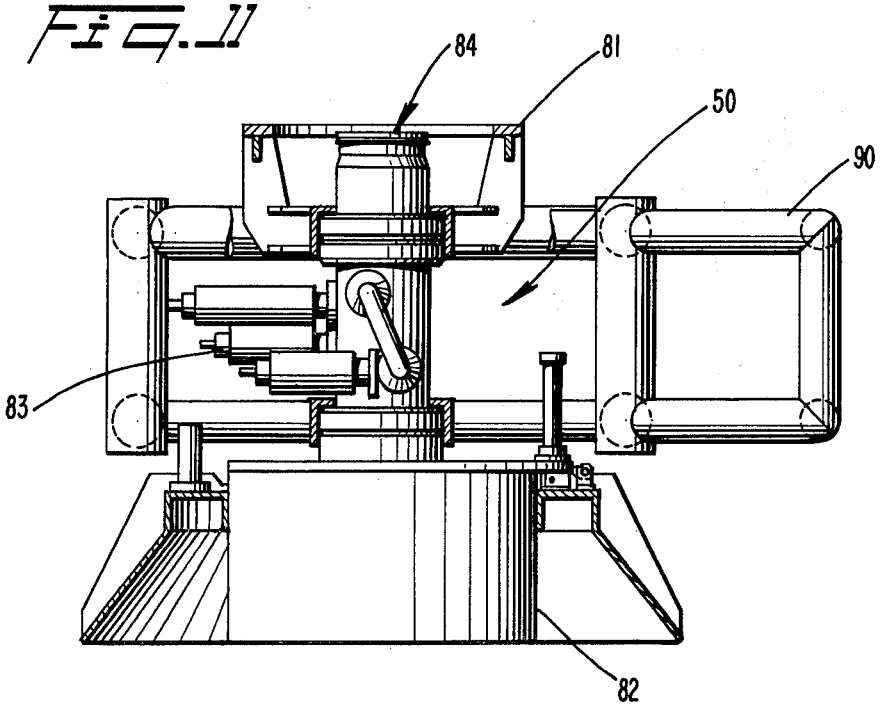
FIG. 11 is a side elevation view of the master valve assembly and associated protective alignment frame shown in FIG. 10.

Referring now to FIGS. 2, 9 and 10, final alignment and operative connection of wellhead connector means 15 with wellhead 14, or preferably with master valve assembly 50 which is coupled to wellhead 14, is preferably achieved using conventional funneling alignment techniques. One such technique employs a large diameter, downwardly directed funnel 80 connected to the bottom of fluid connection assembly 49 and/or guide frame 60. As wellhead connector means 15 is lowered, funnel 80 is guided over a mating alignment structure, e.g. ring 81, and the wellhead connector means isrotated into the final, aligned position. Funnel 80 is then retracted upward, allowing well connector means 15 to operatively engage the mandrel of wellhead 14 (or master valve assembly 50) thereby establishing fluid communication.

Such a guide funnel technique may also be used to connect wellhead connector means 15 to drilling riser 61, with funnel 62 (FIG. 2) being secured to the riser, or a running tool, and guided over landing ring 62 on the wellhead connector means.

Master valve assembly 50, as shown in FIGS. 1, 2, 10 and 11, is generally of conventional construction to provide well shut-in capability after drilling is completed and protection before the well is connected to work enclosure manifold 39. It is installed after drilling and completing the well, but before work enclosure hull 13 is installed on base template 11.Master valve assembly 50 typically comprises a lower connector 82 to be attached to the wellhead, a master valve 83 in each string, and a top mandrel 84. A guide funnel technique, as described above in connection with wellhead connector means 15, is preferably utilized to guide master valve assembly 50 onto wellhead 14, if guidelineless installation is employed. Furthermore, guidelineless installation of master valve assembly 50 on base template 11 is preferably facilitated by incorporating a wedgeshaped, protective bumper structure, or guide frame, 90 into the master valve assembly. Except for obvious changes resulting from differences in size, the structure and functioning of guide frame90, are substantially identical to guide frame 60, described above in connection with the installation of wellhead connector means 15, with vertical guides 19 serving to funnel guide frame 90 into position as it is moved laterally during its installation on base template 11.

As shown in FIG. 1, to assist in guidelineless installation of master valve assembly 50, and to provide increased structural protection, base template 11 preferably further comprises bumpers 95 extending along the outer periphery of the template. Thevertical height of bumpers 95 should approximate the height of master valve assembly 50. Installation of master valve assembly 50 requires that the assembly first be lowered to a depth no greater than the top of bumpers 19, then laterally moved into position over wellhead 14, and finally lowered the remaining distance to establish contact with wellhead 14. Master valve assembly 50 is then operatively connected to wellhead 14 via its lower connector 82.

Figure 12:
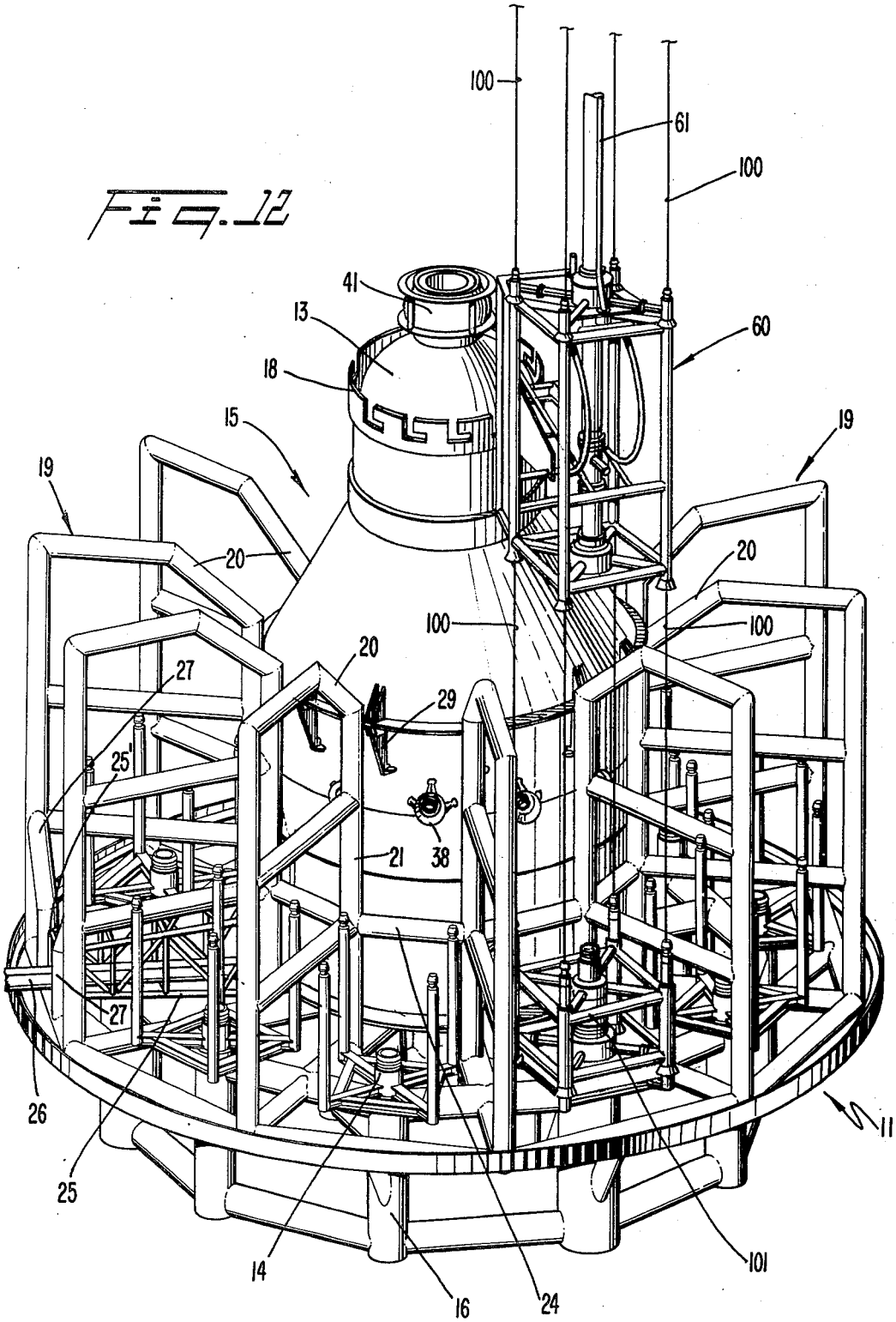
FIG. 12 is a perspective view of a further embodiment of the improved subsea well completion system of the present invention, showing guideline installation of one of the system components.

FIG. 12 illustrates an embodiment of the invention in which a conventional guideline technique is used for installing wellhead connector means 15. In this technique, guidelines 100 are affixed to a guide 101 secured in a well bay on base template 11, strung through vertical piping which forms the corner posts of the wellhead connector frame 60, and then placed under high tension. Wellhead connector means 15 is then lowered along guidelines 100 by riser 61. In such a system, the structure of base template 11 is essentially as described above for guidelineless installation (except for the presence of guide frame 101), and the procedure for installing subsea work enclosure 13 on the template is substantially unchanged from that already described.

Illustrative exemplary parameters for various system components of the present invention are discussed below.

The upper guidance structure of base template 11 is preferably sized and constructed such that, upon lowering, work enclosure hull 11 can be 1.8 meters off center in any lateral direction and will still be funneled on target by the upper guidance structure, or up to 15° off in rotational orientation and will still be properly oriented by the upper guidance structure. Of course, the more offset horizontally the work enclosure hull 13 is, the smaller the orientation misalignment that can be tolerated. Once the work enclosure hull 13 is within the portion of base template 11 formed by vertical legs 21, additional flanges or gussets 22 preferably align the hull within 7.6 cm of the desired alignment. When work enclosure hull 13 is fully lowered on base template 11, preferably only a 15.2 cm clearance will exist between pipeline boom 25 and alignment bumpers 27 at the free end of the boom. This is sufficient to orient work enclosure hull 13 to within plus or minus one-half degree in rotation.

The lower support system of base template 11 is preferably leveled to within plus or minus one-half degree of horizontal.

With a 22-½° angular spacing of blowout preventor (BOP) envelopes around a circular base template 11 during drilling of the wells, and assuming the envelopes to be 3.7m×4.6m, the envelopes need not overlap each other, which is preferable. With such a BOP envelope spacing, a base template diameter of about 18 meters is preferably the minimum diameter for the template.

In the present invention, for water depths in excess of 300 meters, the wells are spaced about base template 11 at a common radius from the center of the template.

In a well completion system designed in accordance with the invention for operation at water depths on the order of 750 meters, base template 11 will preferably be circular in shape and have a diameter of about 19.5 meters and an overall height (bottom of lower support structure to top of upper guidance structure) of about 13.7 meters. Such a template, designed for up to 8 wells, will preferably have a weight of about $2\times10^5$ Kg and a well spacing of 6.7 meters radially. The well to well spacing is about 4.6 meters. The upper guidance structure is preferably about 9.8 meters in height, while the lower support structure has a height of about 3.96 meters.

The structural members forming the upper guidance structure of such a base template 11 are preferably comprised of 50.8 cm outer diameter by 0.750 Wall structural tubing or pipe, while those forming the template lower support structure are 76.2 cm outer diameter by 0.500 Wall structural tubing or pipe.

Typically the wellheads of such a system are 42.5 cm and the leveling pile guides utilize three 106.7 cm outer diameter piles.

In a well completion system designed for operation at water depths on the order of 750 meters in accordance with the invention, subsea work enclosure 13 preferably has anoverall height of about 17.45 meters and an overall outer diameter of about 7.4 meters, with the outer diameter of the cylindrical section 30 of control section 32 being about 3.7 meters. The outside radius of hemispherical section 31 is preferably about 182 cm and the outside radius of hemispherical sections 34, 35 is 370 cm.

In such a system, the weight of work enclosure hull 13 is preferably about 203,000 Kg (less the weight of skirt 37, boom 25 and the internal piping and equipment), and the total outfitted weight is about 457,000 Kg. Sufficient ballast is added within chambers (not shown) in skirt 37 to make the submerged hull (overall) about 45,000 Kg heavy.

Other embodiments of the invention will be apparent to the skilled in the art from consideration of the specification and practice of the invention disclosed herein. It is intended that the specification and examples be considered as exemplary only, with a true scope and spirit of the invention being indicated by the following claims.

What is claimed is:

1. A subsea well completion system for multiple subsea wells, comprising:

a fluid-tight work enclosure hull containing manifold means, the hull having a plurality of radially-disposed lateral penetration means extending therethrough, the penetration means being operatively connected to the manifold means; and a base template lowered to the marine floor in a substantially horizontal position and having a lower support structure for supporting the work enclosure hull, the template further having an upper guidance structure comprising a plurality of substantially vertical guide members mounted in spaced radial array, each guide member extending inwardly toward the center of the template, forming an opening at the central portion of the template for receiving the work enclosure hull, a portion of the upper peripheral surface of each guide member sloping downwardly towad the opening for guiding the hull as it is lowered during installation of the hull onto the template.

2. A subsea well completion system as claimed in claim 1, further comprising a work enclosure hull alignment means extending laterally from the periphery of the work enclosure hull wherein the upper template guidance structure further comprises blocking means rigidly mounted between each pair of adjacent guide members, except that said blocking means is not mounted between one pair of preselected adjacent members to permit receipt between said one pair of guide members of the work enclosure hull alignment means as the hull is lowered during installation of the hull onto the template, thereby orienting the hull.

3. A subsea well completion system as claimed in claim 2, wherein the blocking means are rigidly attached to the guide members.

4. A subsea well completion system as claimed in claim 2, wherein the free end of the work enclosure hull alignment means is smaller than the end adjacent the work enclosure hull, and wherein the base template further comprises a pair of substantially vertically extending bumpers spaced along the periphery of the template at a distance permitting close fitting of said free end therebetween, the vertically extending bumpers having facing portions sloping downwadly for guiding work enclosure hull alignment means as the work enclosure hull lowered during installation onto the template.

5. A subsea well completion system for establishing production capability from multiple subsea wells, comprising:

a fluid-tight work enclosure hull containing manifold means, the hull having a plurality of radially-disposed lateral penetration means extending therethrough, the penetration means being operatively connected to the manifold means; and a base template lowered to the marine floor in a substantially horizontal position and having a lower support structure for supporting the work enclosure hull, the lower support structure of the template includes a plurality of substantially vertical well conductor pipes spaced around the template at a common radial distance from the center of the template for aligning the individual wells during drilling, the upper section of each conductor pipe terminating in a wellhead, the template further having an upper guidance structure comprising a plurality of substantially vertical guide members mounted in spaced radial array, each guide member extending inwardly toward the center of the template forming an opening at the central portion of the template for receiving the work enclosure hull, a portion of the upper peripheral surface of each guide member sloping downwardly toward the opening for guiding the hull as it is lowered during installation of the hull onto the template.

6. A subsea well completion system as claimed in claim 5, further comprising wellhead connector means for releasably connecting a wellhead to one of the lateral penetration means to establish fluid communication therebetween, and wherein the vertical guide members are situated such that adjacent members define a radially inwardly tapered well bay for each wellhead.

7. A subsea well completion system as claimed in claim 6, wherein the wellhead connector means comprises a fluid connection assembly adapted for mounting in a well bay.

8. A subsea well completion system as claimed in claim 7, wherein the wellhead connector means further comprises a rigid, open guide frame surrounding and rigidly secured to the fluid connection assembly, the frame having opposing side portions which are tapered similarly to the radially aligned sides of the well bay in which the wellhead connector means is to be mounted, the tapered side portions being sufficiently spaced apart and extending for a sufficient length and height to provide alignment of the frame in the well bay as it is moved laterally during installation of the wellhead connector means onto the template, whereby a desired orientation of the fluid connection assembly can be achieved.

9. A subsea well completion system as claimed in claim 8, wherein the guide frame is further adapted to provide structural protection for the fluid connection assembly.

10. A subsea well completion system as claimed in claim 8, wherein the guide frame comprises substantially symmetrical upper and lower support members and open, vertical structural members connected between the upper and lower support members, the fluid connection assembly being aligned for inward horizontal connection to a mating lateral penetration means and downward vertical connection to a mating wellhead.

11. A subsea well completion system as claimed in claim 10, wherein the upper and lower support members have a trapezoidal shape.

12. A subsea well completion system as claimed in claim 1, wherein the work enclosure hull includes slips and the base template includes a centrally located mandrel extending substantially vertically upward, and wherein the work enclosure hull is internally pressurized at about 1 atmosphere and possesses a negative bouyancy, whereby the hull is retained on the base template by the force of gravity and by the slips attaching to the mandrel.

13. A subsea well completion system as claimed in claim 12, wherein the work enclosure hull is divided into an upper control section having a breathable atmosphere and a lower service section having an inert, non-combustible, and substantially dry atmosphere.

14. A subsea well completion system as claimed in claim 1, wherein at the work enclosure hull has a substantially cylindrical portion and the lateral penetration means extend through said cylindrical portion, and wherein the guide members form a substantially cylindrical opening at the central portion of the template.

15. A subsea well completion system as claimed in claim 14, wherein at least one laterally extending positioning stop is secured to the outer periphery of the cylindrical portion of the work enclosure hull for contacting a guide member to block movement of the hull as it is rotated during installation on the template, whereby a preselected position of the hull with respect to the template may be obtained.

16. A subsea well completion system as claimed in claim 6, further comprising at least one master valve assembly for providing fluid communication between a wellhead and the associated wellhead connector means.

17. A subsea well completion system as claimed in claim 16, wherein the master valve assembly is mounted in one of the well bays and includes a rigid guide frame having opposing side portions which are tapered similarly to the radially aligned sides of the well bay into which the assembly is to be mounted, the tapered side portions being sufficiently spaced apart and extending for a sufficient length and height to provide alignment of the guide frame in the well bay as it is moved laterally during installation onto the template, whereby a desired orientation of the assembly can be achieved.

18. A subsea well completion system as claimed in claim 17, wherein the upper structure of the template further comprises substantially vertical bumpers extending along the outer periphery of the template for radially guiding and positioning the master valve assembly as it is lowered during installation onto the template, the vertical bumpers providing structural protection and alignment of the assembly.

19. A subsea well completion system as claimed in claim 1 or 5, wherein the lower support structure and upper guidance structure of the template are constructed of rigid structural piping.

20. A subsea well completion system as claimed in claim 1 or 5, wherein the downwardly sloping portion of each guide member defines an angle of about 45° to the horizontal.

21. A subsea system for handling marine well fluids from multiple subsea wells, comprising:

a fluid-tight work enclosure hull having a plurality of radially-disposed lateral penetration means for releasable fluid connection through the hull;

a base template having well bay forming means comprising a plurality of vertical dividers mounted in spaced radial array on the template and extending inwardly from the outer peripheral portion of the template toward the central portion of the template, the upper peripheral surface of each dividing means sloping downwardly toward the central portion of the template for guiding the work enclosure hull as it is lowered during installation onto the template;

wellhead connector means installed in a well bay for releasably connecting a wellhead to a penetration means to establish fluid communication therebetween, the wellhead connector means comprising a fluid connection assembly and a rigid, open guide frame surrounding and rigidly secured to the fluid connection assembly, the width of the radially outermost portion of the guide frame, with respect to the central portion of the template, being adapted to prevent lateral and radial inward misorientation of the guide frame and the wellhead connector means as they are moved laterally into the well bay during installation thereof onto the template.

22. A subsea base template as claimed in claim 21, wherein the template is substantially circular, when viewed from above, and wherein the well conductor pipes and the wellheads are spaced around the template at a common radial distance from the center of the template.

23. A subsea base template for guiding marine floor well drilling equipment at multiple wells and supporting a subsea work enclosure hull and wellheads, comprising:

a lower support structure comprising a substantially horizontally aligned, open tubular framework and a plurality of substantially vertical well conductor pipes spaced around the peripheral portion of the framework and integral therewith, for aligning the well drilling equipment, the upper section of each well conductor pipe terminating in a wellhead, the central portion of the framework being adapted to support the subsea work enclosure hull and the peripheral portion being adapted to support the wellheads; and an upper guidance structure comprising a plurality of guide members rigidly mounted on, and extending vertically from, the lower support structure in spaced radial array, each guide member extending inwardly toward the center of the template, forming a substantially cylindrical opening at the central portion of the framework for receiving the work enclosure hull, a portion of the upper surface of each guide member sloping downwardly toward the cylindrical opening for guiding the work enclosure hull as it is lowered during installation thereof onto the template, the guide members further providing structural protection for the work enclosure hull and the wellheads.

24. A subsea base template as claimed in claim 23, further comprising means for securing the template to the marine floor in a substantially horizontal position.

25. A subsea base template as claimed in claim 23, wherein the vertical guide members are situated such that adjacent guide members define a well bay for each wellhead.

26. A subsea base template as claimed in claim 23, wherein the upper guidance structure of the template further comprises substantially vertical bumpers extending along the outer periphery of the template for radially guiding and positioning a master valve assembly over said wellheads as the valve assembly is lowered during installation thereof onto the template.

27. A subsea base template as claimed in claim 23, wherein the lower support structure and upper guidance structure of the template are constructed of rigid structural piping.

28. A subsea base template as claimed in claim 23, wherein the downwardly sloping portion of each guide member defines an angle of about 45° to the horizontal.

29. A subsea base template for guiding marine floor well drilling equipment at multiple wells and supporting a subsea work enclosure hull and wellheads, comprising:

a lower support structure comprising a substantially horizontally aligned, open tubular framework and a plurality of substantially vertical well conductor pipes spaced around the peripheral portion of the framework and integral therewith, for aligning the well drilling equipment, the upper section of each well conductor pipe terminating in a wellhead, the central portion of the framework being adapted to support the subsea work enclosure hull and the peripheral portion being adapted to support the wellheads; and an upper guidance structure comprising a plurality of guide members rigidly mounted on, and extending vertically from, the lower support structure in spaced radial array, each guide member extending inwardly toward the center of the template, forming a substantially cylindrical opening at the central portion of the framework for receiving the work enclosure hull, a portion of the upper surface of each guide member sloping downwardly toward the cylindrical opening for guiding the work enclosure hull as it is lowered during installation thereof onto the template, the guide members further providing structural protection for the work enclosure hull and the wellheads, the upper guidance structure further comprising blocking means rigidly mounted between each pair of adjacent guide members, except that said blocking means is not mounted between one pair of preselected adjacent guide members to permit receipt between said one pair of guide members of a work enclosure hull alignment means extending laterally from the periphery of the work enclosure hull as the hull is lowered during installation of the hull onto the template, thereby orienting the hull.

30. A subsea base template as claimed in claim 29, wherein the blocking means are rigidly attached to the guide members.

31. A subsea base template as claimed in claim 30, wherein the base template further comprises a pair of substantially vertically extending bumpers between said one pair of preselected guide members, said bumpers being spaced apart at a distance permitting close fitting of the remote end of the hull alignment means therebetween, the vertically extending bumpers having facing portions sloping downwardly for guiding the hull alignment means and thereby the work enclosure hull, as they are lowered during installation of the hull onto the template.

32. A subsea base template for guiding marine floor well drilling equipment at multiple wells and supporting a subsea work enclosure hull, wellheads, and wellhead connector means, comprising:

a lower support structure comprising a substantially horizontally aligned, open tubular framework and a plurality of substantially vertical well conductor pipes spaced around the peripheral portion of the framework and integral therewith, for aligning the well drilling equipment, the upper section of each well conductor pipe terminating in a wellhead, the central portion of the framework being adapted to support the subsea work enclosure hull and the peripheral portion being adapted to support the wellheads and wellhead connector means; and an upper guidance structure comprising a plurality of guide members rigidly mounted on, and extending vertically from, the lower support structure in spaced radial array, each guide member extending inwardly toward the center of the template, forming a substantially cylindrical opening at the central portion of the framework for receiving the work enclosure hull, a portion of the upper surface of each guide member sloping downwardly toward the cylindrical opening for guiding the work enclosure hull as it is lowered during installation thereof onto the template, the vertical guide members being situated such that adjacent members define a radially inwardly tapered well bay for each wellhead for funneling the wellhead connector means into place during installation thereof onto the template;

the guide members further providing structural protection for the work enclosure hull, the wellheads, and the wellhead connector means.

33. A method of establishing production capability from multiple subsea wellheads on a base template lowered to the marine floor, comprising:

providing a work enclosure hull containing a manifold, the hull having a substantially cylindrical portion with a plurality of radially-disposed lateral hull penetrators extending therethrough and operatively connected to the manifold;

providing an upper guidance structure on the template comprising a plurality of substantially vertical guide members mounted in spaced radial array, each guide member extending inwardly from the outer periphery of the template, thereby providing a substantially cylindrical opening at the central portion of the template for receiving the work enclosure hull, a portion of the upper peripheral surface of each guide member sloping downwardly toward the cylindrical opening;

lowering the work enclosure hull from a position directly above the template and funneling it through the upper guidance structure into the cylindrical opening at the central portion of the template, the work enclosure hull being guided into its resting position on the template by the guide members; and establishing subsea fluid communication between the subsea wellheads and the work enclosure hull.

34. A method as claimed in claim 33, wherein the fluid communication between the work enclosure hull and the wellheads is established by operatively connecting a wellhead connector therebetween within a well bay defined by adjacent vertical guide members.

35. A method as claimed in claim 34, including the step of lowering the wellhead connector in the vicinity of the template and laterally moving the wellhead connector into the well bay, the wellhead connector being guided into its resting position on the template by the adjacent vertical guide members defining the well bay.

* * * * *